US007452314B2

(12) United States Patent
Mills et al.

(10) Patent No.: US 7,452,314 B2
(45) Date of Patent: Nov. 18, 2008

(54) STABILITY ADJUSTABLE UNIT

(75) Inventors: Alden Morris Mills, Larkspur, CA (US); John James Argitis, Fiskdale, MA (US); David Hawley, Worcester, MA (US)

(73) Assignee: Core Perform, LLC, Fiskdale, MA (US)

( * ) Notice: Subject to any disclaimer, the term of this patent is extended or adjusted under 35 U.S.C. 154(b) by 0 days.

(21) Appl. No.: 11/109,866

(22) Filed: Apr. 20, 2005

(65) Prior Publication Data

US 2005/0233868 A1 Oct. 20, 2005

Related U.S. Application Data

(60) Provisional application No. 60/563,457, filed on Apr. 20, 2004.

(51) Int. Cl.
*A63B 26/00* (2006.01)

(52) U.S. Cl. ..... 482/142; 482/148; 440/102

(58) Field of Classification Search ..... 482/148, 482/95–100, 70–72, 142; 440/102–106, 440/12–15, 32

See application file for complete search history.

(56) References Cited

U.S. PATENT DOCUMENTS

| | | | | | |
|---|---|---|---|---|---|
| 3,394,934 | A * | 7/1968 | Elia et al. | ..... | 482/72 |
| 4,900,013 | A * | 2/1990 | Rodgers, Jr. | ..... | 482/70 |
| 5,795,270 | A * | 8/1998 | Woods et al. | ..... | 482/72 |
| 5,827,158 | A * | 10/1998 | Drecksel | ..... | 482/96 |
| 5,947,872 | A * | 9/1999 | Ryan et al. | ..... | 482/51 |
| 7,070,415 | B2 * | 7/2006 | Hojo et al. | ..... | 434/247 |

* cited by examiner

*Primary Examiner*—Lori Amerson
(74) *Attorney, Agent, or Firm*—Charter Advisory Partners, LLC; Matthew J. Lattig

(57) ABSTRACT

A stability adjustable unit for a seat of an exercise device that is configured for movement on the device may include a sub-assembly connected between the seat and a roller assembly of the device on which the seat rests. The unit may include a selector provided on the sub-assembly and operable by a user seated on the seat to vary a degree of stability of the seat.

23 Claims, 6 Drawing Sheets

STABILITY ADJUSTABLE UNIT

PRIORITY STATEMENT

This application claims the benefit under 35 U.S.C. § 119 (e) of U.S. Provisional Application Ser. No. 60/563,457 to Mills et al. and entitled "STABILITY ADJUSTABLE UNIT", filed Apr. 20, 2004 in the United States Patent & Trademark Office, the disclosure of which is incorporated herein in its entirety by reference.

BACKGROUND OF THE INVENTION

1. Field of the Invention

The present invention relates generally to a stability adjustable unit for a seat of an exercise device, a seat assembly of an exercise device that is configured with a stability adjustable unit, and to an exercise device configured with a stability adjustable unit.

2. Description of the Related Art

Today's fitness machines typically offer only stable seats, depriving the user of a more efficient and effective workout. For example, when training on the water, rowers are faced with a row boat's lateral motion, rocking side to side. However, today's rowers use a rowing machine with a non-stability adjustable seat (stable seat only). By training on a stable seat, rowers are thus deprived of a more realistic training environment, and/or a more complete workout.

SUMMARY OF THE INVENTION

An example embodiment of the present invention is directed to a stability adjustable unit for a seat of an exercise device that is configured for movement on the device. The unit may include a sub-assembly connected between the seat and a roller assembly of the device on which the seat rests, and a selector provided on the sub-assembly and operable by a user seated on the seat to vary a degree of stability of the seat.

Another example embodiment of the present invention is directed to a seat assembly for an exercise device. The seat assembly may include a seat configured for movement on the device, and a sub-assembly connected between the seat and a roller assembly of the device on which the seat rests. The seat assembly may include a selector provided on the sub-assembly and operable by a user seated on the seat to select a stability selection for the seat between a stable seat setting, in which the seat is in a substantially horizontal position, and an unstable seat setting, in which the seat is in a substantially tilted position from horizontal.

Another example embodiment of the present invention is directed to an exercise device. The exercise device may include a seat configured for movement on the device, and a sub-assembly connected between the seat and a roller assembly of the device on which the seat rests. The seat assembly may include a selector provided on the sub-assembly and operable by a user seated on the seat to select a stability selection for the seat between a stable seat setting, in which the seat is in a substantially horizontal position, and an unstable seat setting, in which the seat is in a substantially tilted position from horizontal.

BRIEF DESCRIPTION OF THE DRAWINGS

Example embodiments of the present invention will become more fully understood from the detailed description given herein below and the accompanying drawings, wherein like elements are represented by like reference numerals, which are given by way of illustration only and thus are not limitative of the example embodiments of the present invention.

DETAILED DESCRIPTION OF THE EXAMPLE EMBODIMENTS

The example embodiments of the present invention, as to be described in detail hereafter, may provide one or more of an exercise device, a moveable seat assembly on an exercise device, and/or a unit with adjustable stability that may permit a seat of the assembly or device to range from completely stable to unstable, depending upon a user's desired setting. The conventional art is believed silent as to a stability adjustable seat for an exercise device, in which a user may select varying degrees of instability to train and/or strengthen core stabilizer muscles located in the trunk or abdomen of the human body.

In general, FIGS. 1-9 are provided to illustrate example embodiments of the present invention. In these examples, the stability adjustable unit may conform to a seat assembly of a exercise device such as rowing machine, although applicability of the example embodiments are not limited to a rowing machine as is evident to those skilled in the art.

Figure 2:
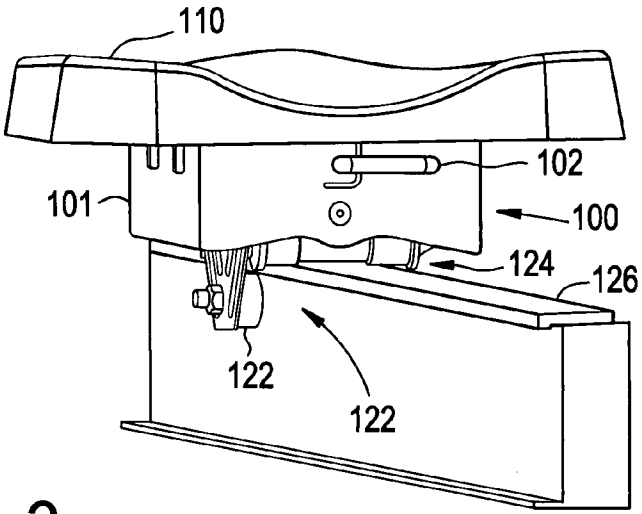
FIG. 2 illustrates a rear view of FIG. 1 in accordance with the example embodiments.
Figure 1:
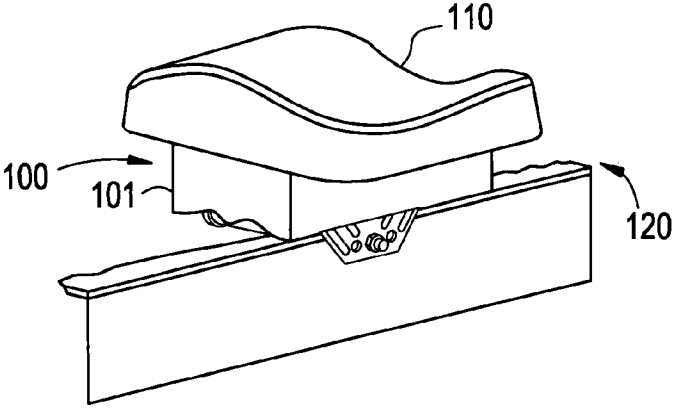
FIG. 1 is a front view of a seat adapted with a stability adjustable unit, in accordance with an example embodiment of the present invention.

FIG. 1 is a front view of a seat adapted with a stability adjustable unit in accordance with an example embodiment of the present invention; and FIG. 2 illustrates a rear view of FIG. 1 in accordance with the example embodiment. As shown in FIG. 1, an existing seat 110 configured for movement, such as a linear rowing motion, and roller assembly 120 of a suitable exercise machine (such as a rowing machine) may be adapted with a stability adjustable unit 100. Referring to FIGS. 1 and 2, the unit 100 may be attached beneath an existing rowing machine seat 110. In general, the unit 100 may include a sub-assembly, which may be embodied as an outer shroud 101. As shown, shroud 101 may be connected between the seat 110 and a roller assembly 120 of the device on which the seat 110 rests, connected to the seat 110 and to rollers 122 of the roller assembly 120. Roller assembly 120 may include track guide rollers 124, which cooperate with rollers 122 for linear or rowing movement of the seat (back and forth) on a guide track 126 of the exercise device. As the basic functional operation of a rowing seat on a rowing machine is known to those skilled in the art, a detailed discussion is omitted herein for purposes of brevity.

As shown in FIG. 2, the shroud 101 may be provided with a selector switch 102 ("selector") at a rear side of the seat 110. The selector switch 102 may be manually operated by the user to select between a stable and unstable seat setting. It is evident to one skilled in the art the selector switch 102 may be provided on any of the sides of shroud 101. The selector switch 102 may thus be easily accessible by the user and may allow for a variance in seat stability. For example, selector switch 102 may permit seat operation between stable to unstable settings (and back to the stable setting) while the user is sitting on the seat 110.

Selector switch 102 may be embodied as a spring-retained, two-position pin 102 which, in the horizontal position, may lock the stability adjustable unit 100 from rolling. In an example, selector switch 102 may be actuated to rotate 90° downward so as to permit roll of the seat 110 at a desired roll angle.

Though the example embodiments are directed to use of a stability adjustable unit 100 with a rowing machine, a rowing machine is just one of many possible applications where the stability adjustable unit 100 may be applicable. Other exercise device embodiments may include, but are not limited to: stationary bicycles, strength machines including a seat and the like, which may be used with seat movement, such as a linear rowing motion or an equivalent or alternative thereof, such as side-to-side (lateral) and/or up and down movement.

Therefore, the selector switch 102 may offer varying degrees of instability to the user, from stable to unstable. The selector switch 102 may be operable while the user is sitting on a seat 110 configured with the unit 100. Further, unit 100 may include the aforementioned protective shroud 101 to protect the user against catching clothing and/or skin on mechanisms within the stability adjustable unit 100.

Figure 3:
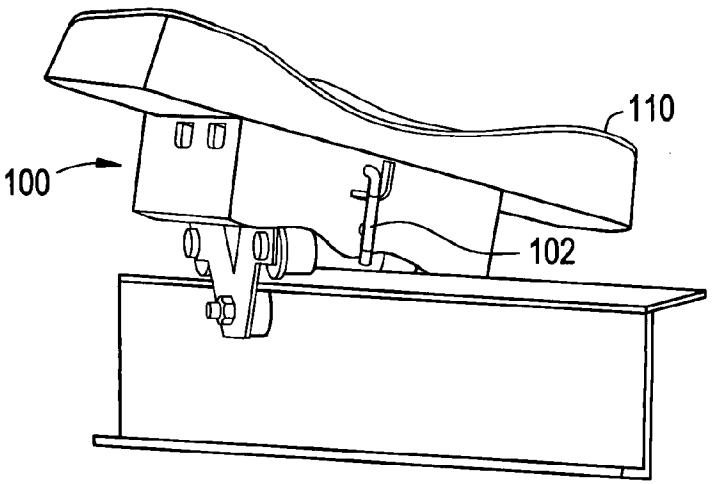
FIG. 3 illustrates a rear view of FIG. 2 to describe a selector in accordance with the example embodiments.

FIG. 3 illustrates a rear view of FIG. 2 to describe the selector switch 102 in further detail. As shown in FIG. 3, actuation of the selector switch 102 in a downward direction from horizontal frees the stability adjustable unit 100 to permit a roll of seat 110 to a desired roll angle. As evident to one having ordinary skill in the art, manipulation of the selector switch 102 may permit the roll angle to be set to any desired angle, such as within an approximate range between about 8° to 20° of roll from vertical, for example. Although the selector switch 102 position is shown between a horizontal and downward position, it is evident that those skilled in the art that the selector switch 102 could be arranged in a different configuration.

Figure 4:
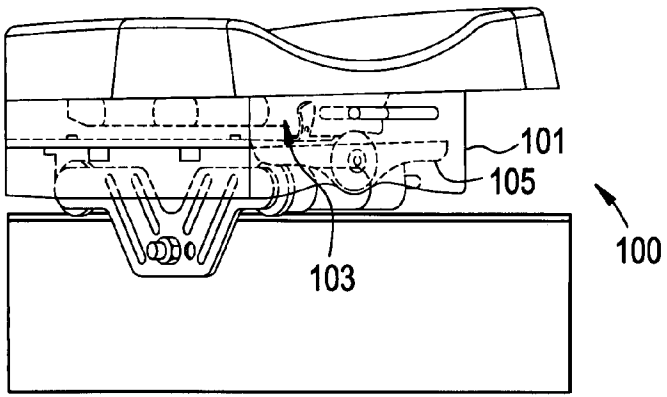
FIG. 4 is a perspective view illustrating the stability adjustable unit in further detail, in accordance with the example embodiments.

FIG. 4 is a perspective view illustrating the stability adjustable unit 100 in further detail. FIG. 4 illustrates the outer shroud 101 in further detail. Shroud 101 may protect clothing and/or fingers of the user from being caught in the internal mechanisms of stability adjustable unit 100. FIG. 4 also illustrates an upper rocker plate 103 and a lower rocker plate 105. Upper rocker plate 103 may assume a substantially semi-curved or convex shape so as to mate with rocker plate 105.

Thus, as shown in FIG. 4, the shroud 101 may encircle the semi-curved (e.g., substantially convex) rocker plate 103, which mates to the substantially or semi-concave rocker plate 105. Of course, the shapes of plates 103, 105 could be in any shape that facilitates meeting engagement, as is evident to one of skill in the art. The shroud 101 may additionally provide a safety feature to prevent someone from pinching clothing or skin while performing exercises on with seat 110 in an unstable seat position.

Figure 5:
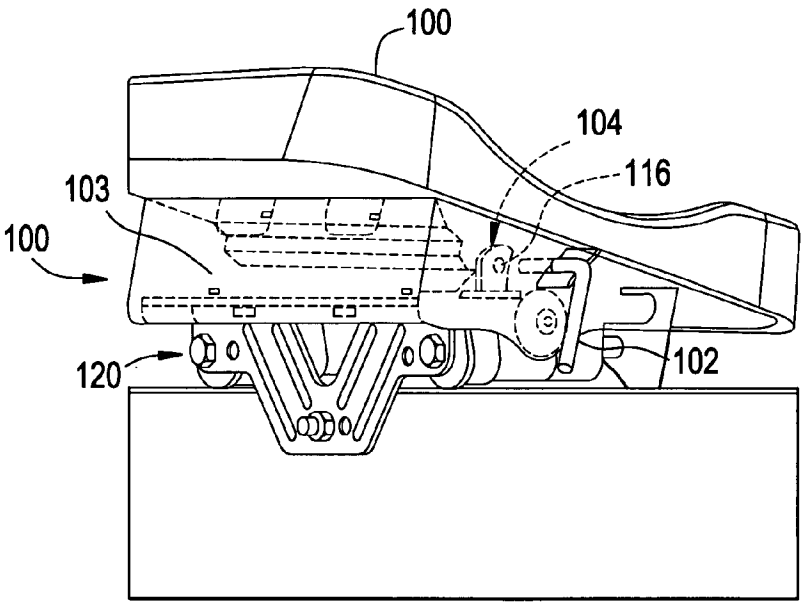
FIG. 5 illustrates a rear perspective view of the seat of the stability adjustable unit illustrating a tilt orientation, in accordance with the example embodiments.

FIG. 5 illustrates a rear perspective view of the seat 110, showing unit 100 in a tilt orientation. Referring to FIG. 5, lower rocker plate 105 may include one or more seat stops 104 that engage or disengage the upper rocker plate 103, depending on the position of the selector switch 102. As shown in FIG. 5, the selector switch 102 engages a corresponding opening 116 in the seat stop 104 to engage or disengage upper rocker plate 103 with lower rocker plate 105, so as to impart rotational movement to the seat 110 on roller assembly 120. Accordingly, selector switch 102 may be operable to activate seat stops 104 for engaging or disengaging the rocker plates 103 and 105, depending on the user's stability selection.

Figure 6C:
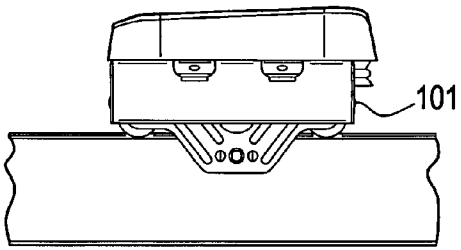
FIGS. 6A-6G illustrate various views of a seat provided with the stability adjustable unit in accordance with the example embodiments.
Figure 6D:
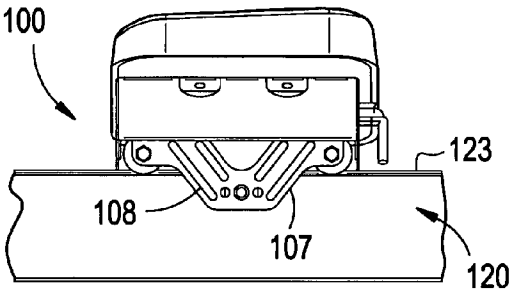
Figure 6B:
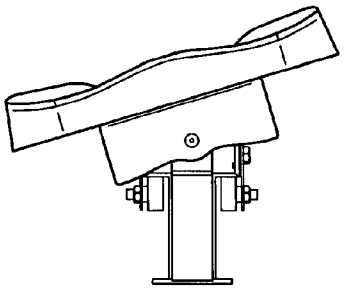
Figure 6G:
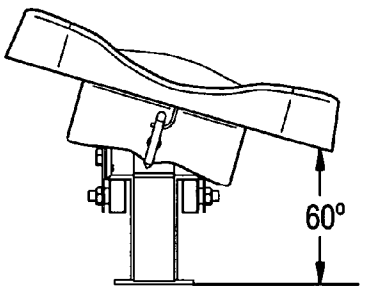
Figure 6E:
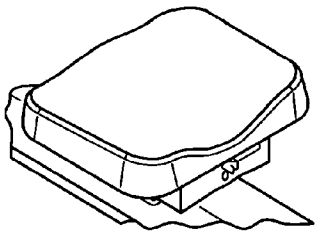
Figure 6A:
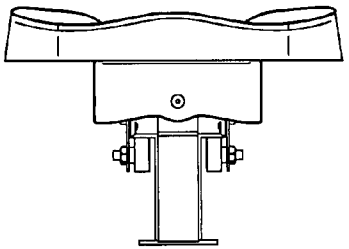
Figure 6F:
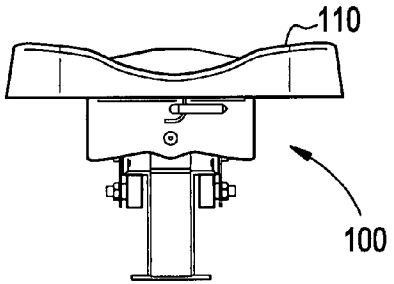

FIGS. 6A-6G illustrate various views of a seat 110 provided with the stability adjustable unit 100 in accordance with the example embodiments of the present invention. Referring to the views in FIGS. 6C and 6D, for example, the sides of the shroud 101 may extend downward a sufficient distance, so as to prevent access by fingers and/or clothing of a user to thereby prevent accidents. As shown in FIG. 6D, the stability adjustable unit 100 may include brace plates 107 having raised dimples (forms 108 formed) thereon. Form 108 may provide additional weight for the stability adjustable unit 100, so that it is stably arranged on a guide 123 of the roller assembly 120. FIGS. 6F and 6G show further orientations of the seat 110 with stability adjustable unit 100 in a horizontal and tilted position (from horizontal), for example.

Figure 7B:
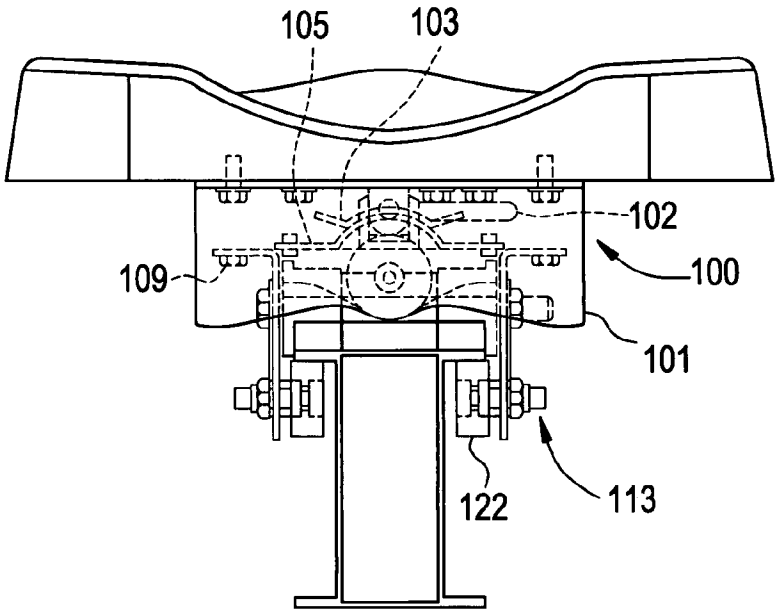
FIGS. 7A and 7B illustrate internal components of the stability adjustable unit 100 in further detail in accordance with the example embodiments.
Figure 7A:
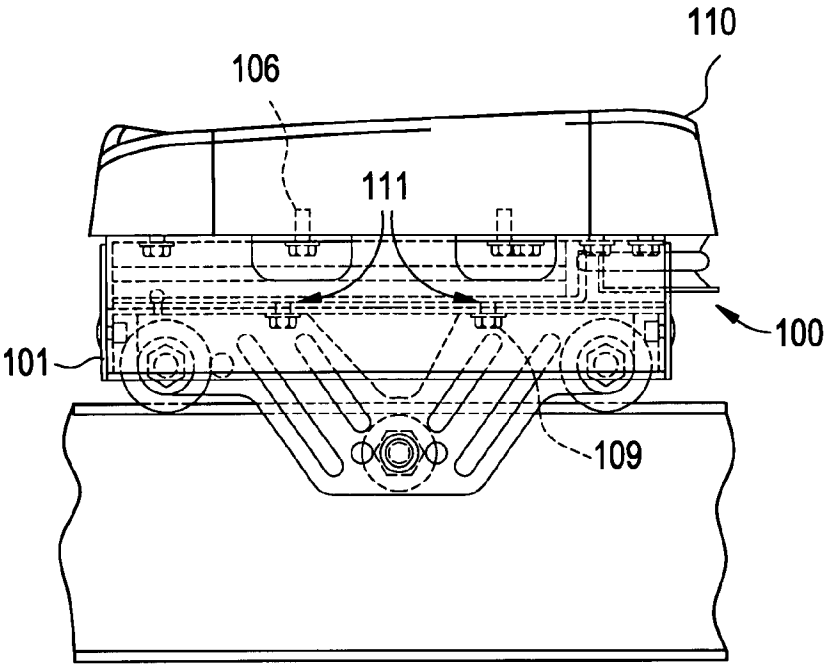

FIGS. 7A and 7B illustrate internal components of the stability adjustable unit 100 in further detail. The stability adjustable unit 100 may be assembled to an existing rowing machine, such as a CONCEPT 2™ rowing machine with existing screws 106, as shown in FIG. 7A, for example. In an example embodiment, a plurality of mechanical fasteners (such as four screws), which may be offset from, or aligned with, each other, may extend through an under side of the seat 110 within pre-driven accesses in an under side of the rowing seat 110.

Additionally, the rowing seat 110 may be provided with a series of studs 111 (only a portion of which is shown in FIG. 7A) that extend through a horizontal surface of the brace plates 107 on the stability adjustable unit 100 and are secured by lock nuts 109. Lock nuts 109 may be embodied as 10-32 nuts with integral lock washers that may be tightened with a given wrench (not shown), for example. Further, a plurality of mechanical fasteners 113 may be provided for securing a vertical portion of the brace plates 107 to rollers 122 of the roller assembly 120, as shown best in FIG. 7B.

Referring to FIG. 7B, the rocker plates 103 and 105 may be rotational support members that may be fabricated from a suitable material such as a plastic and/or a metal. In an example, rocker plates 103, 105 may include some type of polyethylene tape there between. As discussed above, selector switch 102 may be a two-position spring loaded, "L" rod or pin configured to lock unit 100 in the horizontal position.

In an example, selector switch 102 may include indicia that represent the correct lock or unlock position of the selector switch 102. Alternatively, such indicia could be provided on a surface of the sub-assembly, such as on a side of the outer shroud 101 of the stability adjustable unit 100.

Figure 8:
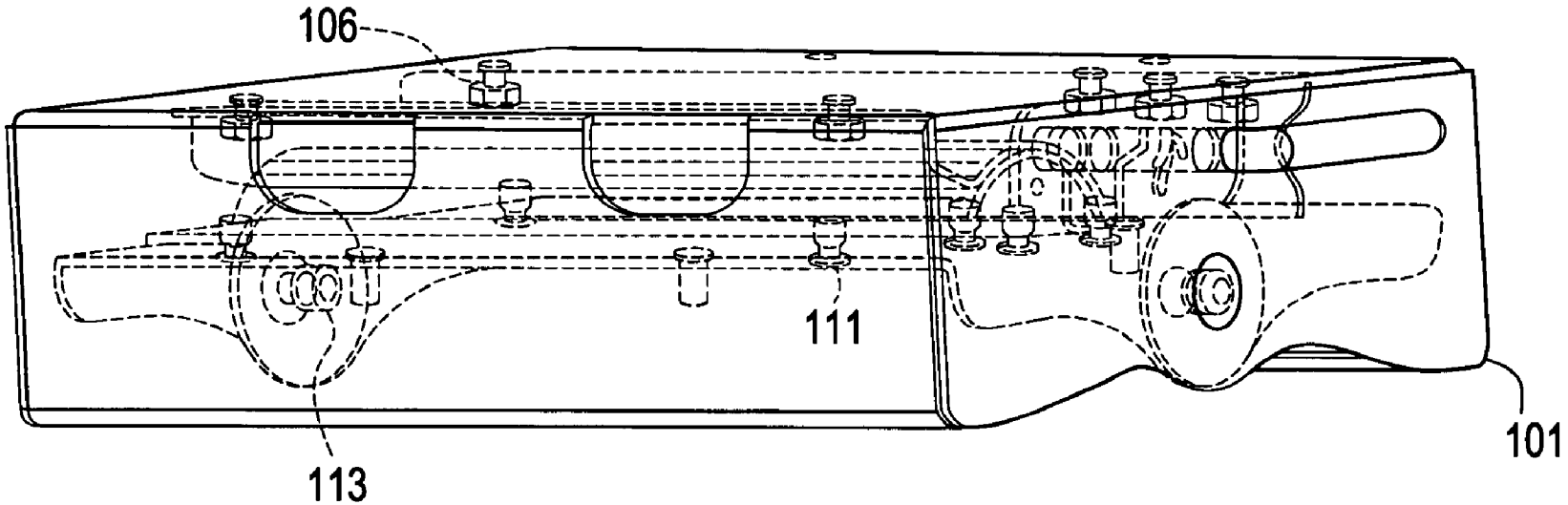
FIG. 8 is a perspective transparent view showing subject components of the stability adjustable unit in further detail in accordance with the example embodiments.

FIG. 8 is a perspective transparent view showing subject components of the stability adjustable unit 100 in further detail. Although the screws 106 and studs 111 may be shown in an offset relationship, one skilled in the art may utilize screws 106 and studs 111 that are in an aligned relationship, e.g., one on top of the other, for example.

Figure 9A:
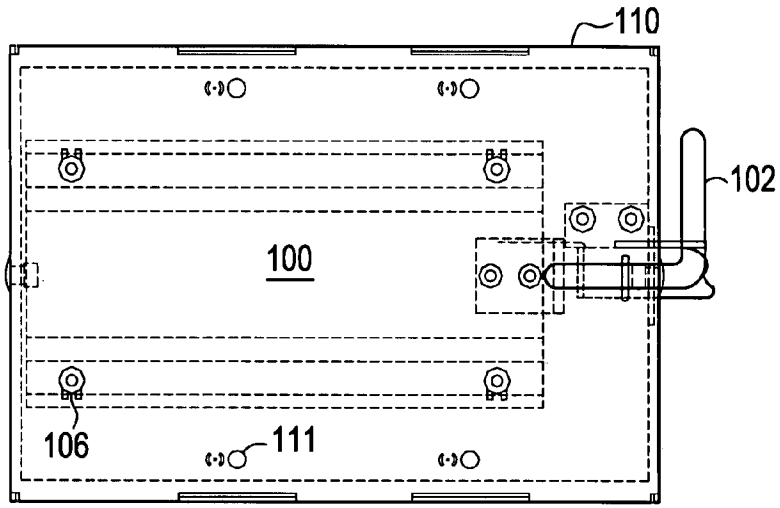
FIGS. 9A-9C illustrate various views of the stability adjustable unit in further detail, in accordance with the example embodiments.
Figure 9C:
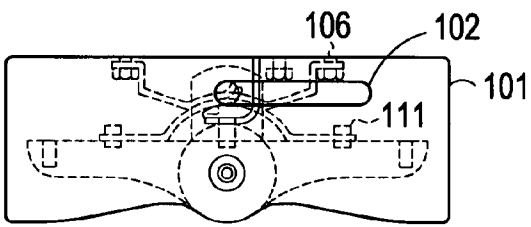
Figure 9B:
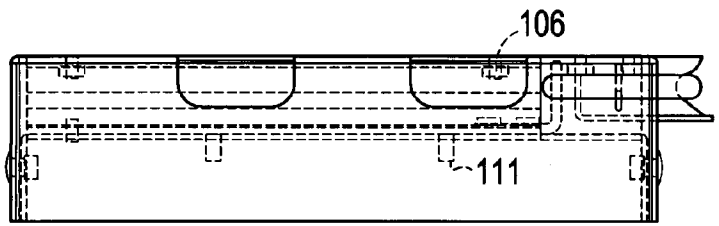

FIGS. 9A-9C shows various views of the stability adjustable unit 100 in further detail. FIGS. 9A-9C further illustrate the arrangement of studs 111 and/or screws 106 securing the stability adjustable unit 100 to a suitable seat 100. As shown in FIGS. 9A and 9B, the screws 106 and studs 111 may be offset from each other as viewed in one of a vertical or horizontal plane through the unit 100. As shown in FIG. 9C, for example, the screws 106 and studs 111 may be configured in a substantially aligned relationship, (one on top of the other) as viewed in one of a vertical or horizontal plane through the unit.

The dimensions of the stability adjustable unit 100 may be selected as desired, as is evident to one having ordinary skill in the art. However, an example length of the stability adjustable unit may be anywhere from about 7 inches to 10 inches. An example width of the stability adjustable unit 100 may be within a suitable range of about 4 inches to 8 inches, and the height of the stability adjustable unit may be set within an example range of about 1.5 inches to 2.5 inches, for example.

The stability adjustable unit 100 may be assembled through a suitable seat 110 of an exercise machine such as the Concept 2™ rowing machine, generally as follows. For example, a user may employ a suitable device such as a wrench to remove existing screws holding the seat 110 to the roller assembly 120. The unit 100, which may include four 10-32 studs 111, may be placed on the roller assembly 120 and four supplied nuts, (such as 10-32 nuts) may be spun onto the studs 111 of the seat 110. The supply wrench may be configured to have another end which fits the 10-32 nuts 109 so that the nuts may be firmly tightened. The seat 110 may then be posted on top of the stability adjustable unit 100 and four 10-32 screws 106 may be inserted into the seat 110 and tightened to a suitable torque with the supply wrench. It is evident to one having ordinary skill in the art that the above process steps are merely one example, and may be performed in a different order than described above.

Accordingly, the example embodiments of the present invention provide a stability adjustable unit configured for a seat of an exercise device, a seat assembly including a stability adjustable unit, and/or an exercise device with a stability adjustable unit which herein may allow users to train core and/or other muscles while simultaneously exercising other muscle groups. By using the stability adjustable unit with an existing seat and roller assembly of a suitable exercise device, such as a rowing machine by example, exercisers may select the degree of seat instability to better simulate and train for the lateral rocking motion typically found in a rowing vessel on water such as row boat, scull, canoe and the like.

Use of a stability adjustable unit as part of a seat or seat assembly of an exercise device may provide stability ranges from completely stable to highly unstable. The user may select this variance while seated on the seat of the exercise device configured with the stability adjustable unit. Furthermore, the unit may be adapted to conform to multiple, different existing exercise devices and/or fitness machines, from strength machines to cardiovascular equipment for example, and may perform under heavy human loads of up to at least about 400 pounds or more.

Thus, the example stability adjustable unit may provide users with core (abdominal) muscles and neurological (balance/reaction) training while they simultaneously exercise other muscle groups. Further, use of the stability adjustable unit may offer a more functional, efficient and effective workouts to users, in an effort to more closely simulate workouts in their desired training environment (e.g., the rower on the rowing machine as compared to a rower on the water).

The example embodiments of the present invention being thus described, it will be obvious that the same may be varied in many ways. For example, although the stability adjustable unit has been described as applicable to a rowing machine or exercise device having a seat, the example embodiments may be applicable to a movable platform of an exercise device on which a user stands, such as a STAIRMASTER® type of machine. Such variations are not to be regarded as departure from the spirit and scope of the example embodiments of the present invention, and all such modifications as would be obvious to one skilled in the art are intended to be included within the scope of the following claims.

What is claimed is:

1. A stability adjustable unit for a seat of an exercise device that is configured for movement on the device, comprising:

a sub-assembly connected between the seat and a roller assembly of the device on which the seat rests, the sub-assembly including rocker means within an interior of the sub-assembly for enabling the seat to roll in at least a side-to-side lateral direction along an axis that is perpendicular to an axis along which the seat and roller assembly move under action by a user seated on the seat; and a selector provided on the sub-assembly and operable by the user seated on the seat to activate the rocker means so as to vary a degree of stability of the seat.

2. The unit of claim 1, wherein the selector is operable to select a stability selection between a stable seat setting, in which the seat is in a substantially horizontal position, and an unstable seat setting, in which the seat is in a substantially tilted position from one or both of a horizontal and vertical plane of the seat.

3. The unit of claim 1, wherein the sub-assembly includes a shroud in a generally rectangular shape, the shroud including a plurality of sides extending downward from the seat to the roller assembly for protecting clothing and/or fingers of the user from being caught within internal components of the unit that are contained within the shroud.

4. The unit of claim 1, wherein the selector is configured as a spring-retained, two-position pin which, in a horizontal position, prevents the unit from rolling, and which is actuated to rotate 90° from horizontal so as to permit roll of the seat at a desired roll angle in the lateral side-to-side direction.

5. The unit of claim 1, wherein the selector permits a variable roll angle for the seat between about 8° to 20° of roll from vertical.

6. The unit of claim 1, wherein the rocker means further includes:

an upper rocker plate, and a lower rocker plate, and the sub-assembly further comprises:

a plurality of seat stops for operative engagement to the upper and lower rocker plates, wherein the shroud substantially encloses the upper and lower rocker plates, and the selector is operable to activate the seat stops for engaging or disengaging the upper and lower rocker plates, based on the user's stability selection.

7. The unit of claim 6, wherein the lower rocker plate is configured to have a substantially concave shape and the upper rocker plate is configured to have a substantially convex shape so as to mate with the lower rocker plate.

8. The unit of claim 6, wherein the selector engages a corresponding opening in a given seat stop to engage or disengage the upper rocker plate with the lower rocker plate, so as to impart rotational movement to the seat on the roller assembly.

9. The unit of claim 1, further comprising:

a pair of brace plates having a plurality of raised forms thereon, wherein the forms provide additional weight for the unit, so that the unit is stably arranged on a guide of the roller assembly.

10. The unit of claim 9, further comprising:

a plurality of screws extending into pre-driven accesses within an under side of the seat, a plurality of studs provided on the seat and extending through a horizontal portion of the brace plates, a plurality of corresponding lock nuts for securing the studs, and a plurality of mechanical fasteners for securing a vertical portion of the brace plates to rollers of the roller assembly.

11. The unit of claim 10, wherein the screws and studs are offset from each other as viewed in one of a vertical phase and horizontal plane through the unit.

12. The unit of claim 10, wherein the screws and studs are configured in an aligned relationship as viewed in one of a vertical plane and horizontal plane through the unit.

13. The unit of claim 1, further comprising:

indicia for representing a lock position or an unlock position of the selector to the user.

14. The unit of claim 13, wherein the indicia is provided on the selector.

15. The unit of claim 13, wherein the indicia is provided on a surface of the sub-assembly.

16. The unit of claim 1, wherein a length dimension of the unit is between about 7-10 inches.

17. The unit of claim 1, wherein a width dimension of the unit is between about 4-8 inches.

18. The unit of claim 1, wherein a height dimension of the unit is between about 1.5-2.5 inches.

19. A seat assembly for an exercise device, comprising:

a seat configured for movement on the device; and a sub-assembly connected between the seat and a roller assembly of the device on which the seat rests, the sub-assembly including rocker means within an interior of the sub-assembly for enabling the seat to roll in at least a side-to-side lateral direction along an axis that is perpendicular to an axis along which the seat and roller assembly move under action by a user seated on the seat.

20. An exercise device, comprising:

a seat configured for movement on the device;

a roller assembly in connective engagement to the seat for lateral movement of the seat along a track guide of the device;

a sub-assembly connected between the seat and the roller assembly, the sub-assembly including rocker means within an interior of the sub-assembly for enabling the seat to roll in at least a side-to-side lateral direction along an axis that is perpendicular to an axis along which the seat and roller assembly move under action by a user seated on the seat; and a selector provided on the sub-assembly and operable by the user seated on the seat to select a desired range of roll in the side-to-side direction for the seat by activating the rocker means.

21. The unit of claim 1, wherein the sub-assembly further enables to seat to be articulated in and up and down direction along the same axis in which the seat and roller assembly move under user action.

22. The seat assembly of claim 19, wherein the sub-assembly further enables to seat to be articulated in and up and down direction along the same axis in which the seat and roller assembly move under user action.

23. The device of claim 20, wherein the sub-assembly further enables to seat to be articulated in and up and down direction along the same axis in which the seat and roller assembly move under user action.

* * * * *

UNITED STATES PATENT AND TRADEMARK OFFICE

CERTIFICATE OF CORRECTION

PATENT NO. : 7,452,314 B2
APPLICATION NO. : 11/109866
DATED : November 18, 2008
INVENTOR(S) : Mills et al.

It is certified that error appears in the above-identified patent and that said Letters Patent is hereby corrected as shown below:

Column 1, line 28, "environment, and/or" should read --environment and/or--; lines 37, 42, 44, 53, 55, "sub-assembly" should read --subassembly--

Column 2, line 38, "stable to unstable, depending upon" should read --stable to unstable depending upon--; line 46, "a exercise device" should read --an exercise device--; line 47, "such as rowing machine" should read --such as a rowing machine--; line 48, "although applicability of the example embodiments are" should read --although applicability of the example embodiments is--; line 52, ";" should read --,--; line 60, "sub-assembly" should read --subassembly--

Column 3, line 16, "which" should read --that--; line 19, "roll" should read --the roll--; line 25, ":" should read --,--; line 45, "for example" is redundant and should be removed; line 47, "that those skilled in the art" should read --to those skilled in the art--; line 60, "e.g." should read --i.e.--; line 66, "on with seat 110 in an unstable seat position" should read --on seat 110 with seat 110 in an unstable seat position--

Column 4, line 8, "rocker plate 105, so as to" should read --rocker plate 105 so as to--; line 17, "distance, so as to" should read --distance so as to--; line 18, "to thereby prevent accidents" should read --to prevent accidents thereby--; line 22, "stability adjustable unit 100, so that" should read --stability adjustable unit 100 so that--; lines 34, 35, "under side" should read --underside--; line 38, "is" should read --are--; line 52, "'two-position spring loaded," should read --two-position, spring-loaded; line 57, "sub-assembly" should read --subassembly--; line 64, "for example" is redundant and should be removed Column 5, line 1, "seat 100" should read --seat 110--; line 6, "relationship, (one on top of the other) as viewed" should read --relationship (one on top of the other), as viewed--; Line 24, "four supplied nuts, (such as 10-32 nuts)" should read --four supplied nuts (such as 10-32 nuts)--; lines 26, 38, "which" should read --that--; line 32, "in a different order than described above" should read --in a different order from described above--; line 42, "by example" is redundant and should be removed;

Signed and Sealed this
Twelfth Day of April, 2011

David J. Kappos

David J. Kappos
*Director of the United States Patent and Trademark Office* line 45, “such as row boat” should read --such as a rowboat--; line 54, “at least 400 pounds or more” should read --400 pounds or more-- (“at least” is redundant and should be removed); line 60, “a more functional, effective and efficient workouts” should read --a more functional, effective and efficient workout--; line 61, “in an effort to more closely simulate” should read --in an effort to simulate more closely--

Column 6, lines 12, 15, 20, 29, 47, “sub-assembly” should read --subassembly--; line 32, “clothing” should read --the clothing--; lines 36, 37, “which” should read --that--

Column 7, line 1, “weight for the unit, so that” should read --weight for the unit so that--; line 6, “under side” should read --underside--; line 15, “phase” should read --plane--; lines 26, 35, 36, “sub-assembly” should read --subassembly--

Column 8, lines 2, 11, 12, 18, 22, 26, 31, “sub-assembly” should read --subassembly--; lines 23, 27, 31, “in and up and down direction” should read --in an up and down direction--